United States Patent [19]

Nagati

[11] 4,273,316

[45] Jun. 16, 1981

[54] METALLURGICAL VESSEL SUSPENSION SYSTEM

[75] Inventor: Rashed N. Nagati, Mars, Pa.

[73] Assignee: Pennsylvania Engineering Corporation, Pittsburgh, Pa.

[21] Appl. No.: 60,993

[22] Filed: Jul. 27, 1979

[51] Int. Cl.[3] ..... C21C 5/50

[52] U.S. Cl. ..... 266/246

[58] Field of Search ..... 266/246

[56] References Cited

U.S. PATENT DOCUMENTS

| | | | |
|---|---|---|---|
| 3,146,983 | 9/1964 | Johnson | 266/246 |
| 3,385,588 | 5/1968 | Puxkandl | 266/246 |
| 3,738,630 | 6/1973 | Stafford | 266/246 |
| 3,892,394 | 7/1975 | Krause | 266/246 |
| 3,910,654 | 10/1975 | Schwarz | 266/246 |

*Primary Examiner*—P. D. Rosenberg

[57] ABSTRACT

A molten metal processing vessel is supported on a trunnion ring by a plurality of triangular members and adjustable links. Each triangular member is pivotally connected to the vessel to a clamp ring which engages the upper trunnion ring flange. The connection at the apex of the triangular member includes a ball and socket for universal pivotal movement. The links are pivotally connected to the vessel and to a second clamp ring which engages the lower trunnion ring flange. A plurality of disk springs are disposed between the second clamp ring and the trunnion ring.

12 Claims, 7 Drawing Figures

METALLURGICAL VESSEL SUSPENSION SYSTEM

BACKGROUND OF THE INVENTION

This invention relates to metallurgical vessels and more specifically, with a system for mounting said vessels to a trunnion ring.

One prior art vessel support is disclosed in U.S. Pat. No. 3,146,983 wherein a plurality of links pivotally connect a convertor vessel to the upper trunnion ring flange to support the vessel in a vertical position and to allow differential expansion between the vessel and the ring. However, these links are incapable of supporting the vessel when it is tilted to a generally horizontal position. Accordingly, in such prior art vessel suspension systems, it was necessary to provide a plurality of brackets adjacent the trunnion pin for supporting the vessel while the same was being turned up and turned down. In addition, the connection of such prior art assembles were capable of pivotal movement only about a fixed axis.

SUMMARY OF THE INVENTION

It is an object of the invention to provide a new and improved support for pneumatic metallurgical vessels.

A further object of the invention is to provide a metallurgical vessel suspension system which supports the vessel in its vertical and tilted positions and permits differential expansion between the vessel and a surrounding trunnion ring.

A further object of the invention is to provide a convertor vessel suspension system wherein mechanical load is relatively uniformly distributed around the trunnion ring.

Still another object of the invention is to provide a support for convertor vessels which does not restrict axial vessel expantion.

Yet another object of the invention is to provide a support for converter vessels having a plurality of pivotal connections which permits misalignment between the vessel and trunnion ring.

These and further objects of the invention will become more apparent from the detailed description of the invention taken with the accompanying drawings.

BRIEF DISCRIPTION OF THE DRAWINGS

DESCRIPTION OF THE PREFERRED EMBODIMENTS

Figure 1:
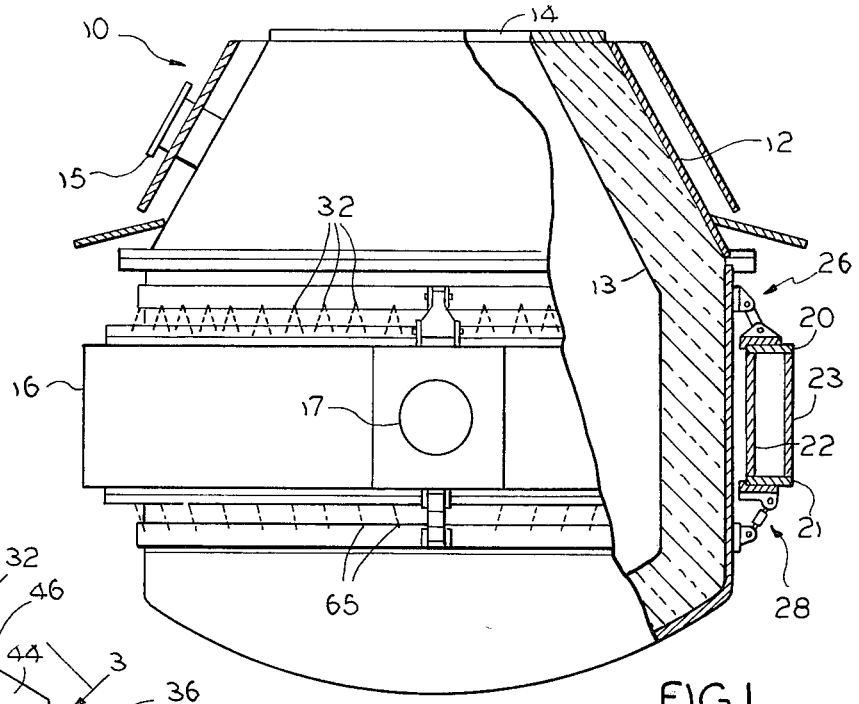
FIG. 1 is a side elevational view with parts broken away schematically illustrating a convertor vessel having a suspension system according to the present invention.

FIG. 1 shows a convertor vessel 10 which is one example of a metallurgical vessel to which the suspension system according to the present invention is applicable. As those skilled in the art will appreciate, however, the suspension system is applicable to any metallurgical vessel which is supported within a so-called trunnion ring. The vessel 10 is shown to include a metallic shell 12 and a refractory lining 13. A top opening 14 permits charging of the vessel with hot metal or scrap. The vessel 10 may also have a pouring spout 15 which permits the discharge of its contents into a ladle or other suitable receptacle when the vessel is tipped.

As seen in FIG. 1, the vessel 10 is surrounded by a concentric trunnion ring 16. Extending from each of the diametrically operative sides of trunnion ring 16 are a pair of coaxial trunnion pins 17, only one of which is seen in FIG. 1. Pins 17 are usually journaled in suitable supports (not shown) and are coupled to a suitable drive mechanism (not shown) which provides the requisite torque for tilting the trunnion ring 16 and the vessel 10 which it supports. The trunnion pins 17 may also be hollow so as to allow the entry and exit of cooling water to the interior of trunnion ring 16. In the illustrated examples, the interior of trunnion ring 16 is intended to be water-cooled but the specific details of construction are omitted since they are well-known in the art and form no part of the present invention.

Figure 2:
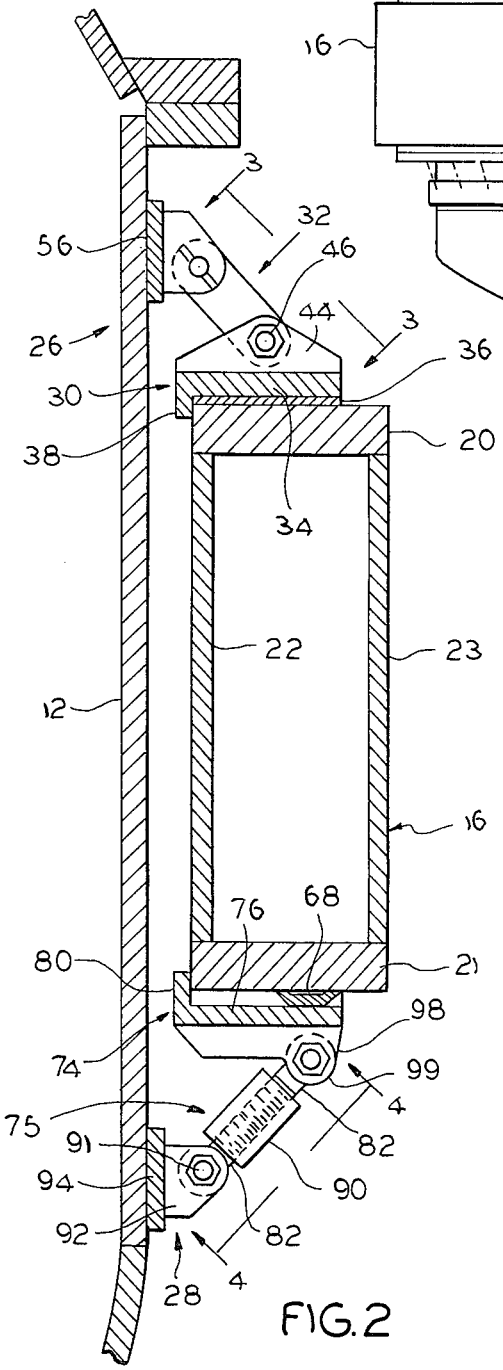
FIG. 2 is a cross-sectional view showing a portion of the suspension system of FIG. 1 in greater detail.
Figure 3:
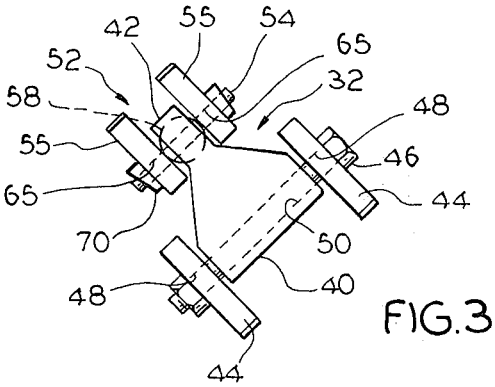
FIG. 3 is a view taken along lines 3—3 of FIG. 2.
Figure 4:
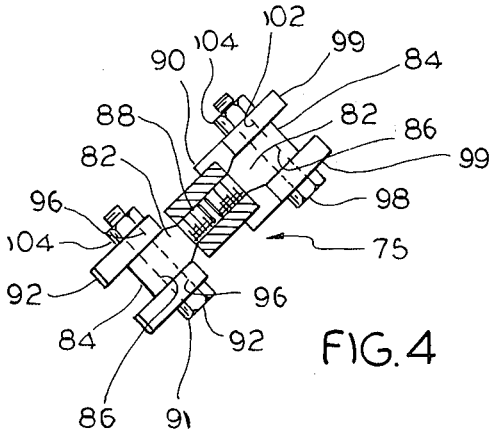
FIG. 4 is a view taken along lines 4—4 of FIG. 2.

Trunnion ring 16 is shown in FIGS. 1 and 2 to include a top ring-like flange 20 and a similar bottom flange 21 which is spaced from top flange 20 and is arranged in a generally concentric parallel relation with respect thereto. The flanges 20 and 21 are joined at their edges by an annular inner wrapper plate 22 and an annular outer wrapper plate 23 which is concentric with wrapper plate 22 and spaced therefrom in a generally parallel relation. The joints between flanges 20 and 21 and wrapper plates 22 and 23 may be secured in any suitable manner such as by welding. It will also be appreciated that trunnion ring 16 in the illustrated example is essentially a hollow, circular box girder. While not shown in the drawings, trunnion ring 16 may also be reinforced internally by a series of circumferentially spaced radially disposed plates each of which has an aperture to permit the circulation of cooling water, if desired. It will also be apparent that the vessel suspension system according to the present invention is applicable whether the trunnion ring 16 has a configuration illustrated in FIGS. 1 and 2 or is in another form such as an I-beam, channel or various other cross-sectional shapes.

As seen more particularly in FIG. 2, the vessel 10 is supported on the trunnion ring 16 by an upper suspension assembly 26 and a lower suspension assembly 28. The upper suspension assembly 26 includes a clamp ring 30 which engages the upper flange 20 and a plurality of generally triangular links 32 which are pivotally connected at their lower ends to the ring 30 and at their upper ends to the vessel 12. Ring 30 is generally coradial with top flange 20 and may comprise a single member or a plurality of arcuate segments. In transverse cross-section, ring 30 is generally L-shaped with its large leg 34 disposed above and extending parallel to top flange 20. Leg 34 of ring 30 may engage flange 20 directly or a thin metallic shock absorber pad 36 may be disposed therebetween. The shorter leg 38 of clamp ring 30 extends downwardly behind the inner edge of flange 20.

Each link 32 includes a relatively thick base portion 40 which tapers down to a thin neck portion 42. The base portion 40 of each link 32 is pivotally mounted between a pair of upstanding brackets 44 which are affixed in spaced apart relation to the upper surface of clamp ring 32. Specifically, a pivot bolt 46 extends through aligned holes 48 in brackets 44 and a bore 50 extending through the base portion 40.

Figure 5:
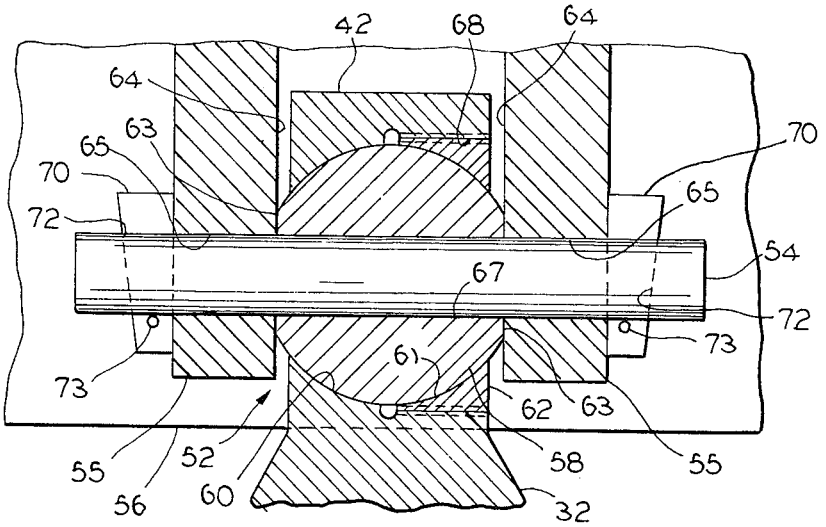
FIG. 5 is a view taken along lines 5—5 of FIG. 2.

As seen in FIG. 5, the neck portion 42 of each link 32 is also connected for universal pivotal movement by means of a ball joint 52 and a pin 54 which extends through the ball joint and a pair of parallel, spaced apart lugs 55 mounted on a ring 56 affixed to the shell 12. Ball joint 52 includes a ball 58 and a socket consisting of a first concave surface 60 formed on the neck portion 42 and a complementary second surface 61 formed in a ball retainer member 62. The ball 58 is larger in diameter than the width of neck portion 42 and has parallel flat portions 63 formed on its opposite sides and which engage the inner surfaces 64 of lugs 55. The pin 54 extends through a pair of aligned opening 65 formed in lugs 55 and a bore 67 extending through ball 58 perpendicularly to the surfaces 63. The surfaces 60 and 61 are spherical sections and each has a radius of curvature substantially equal to that of ball 58. The ball retainer 62 is received in a threaded opening 68 formed in one side of neck portion 42 and in a coaxial relation to bore 67. This permits the ball to be inserted into the socket and removed for replacement.

The pin 54 is locked in position by means of a pair of wedges 70 received in tapered openings 72 formed in the pin 54. The wedges 70 bear against the outer surfaces of the lugs 55 and the opening 72 and pins 54 and are in turn releasably secured by pins 73 extending through small holes formed in the narrow portions of wedges 70 and below the pin 54.

It will be appreciated from the description thus far that while the lower end of link 32 will pivot about the axis of bolt 46, the upper end will be free for limited universal movement about ball 58. As a result, the links 32 can adjust to uneven expansion and contraction in different portions of the vessel 10.

Figure 6:
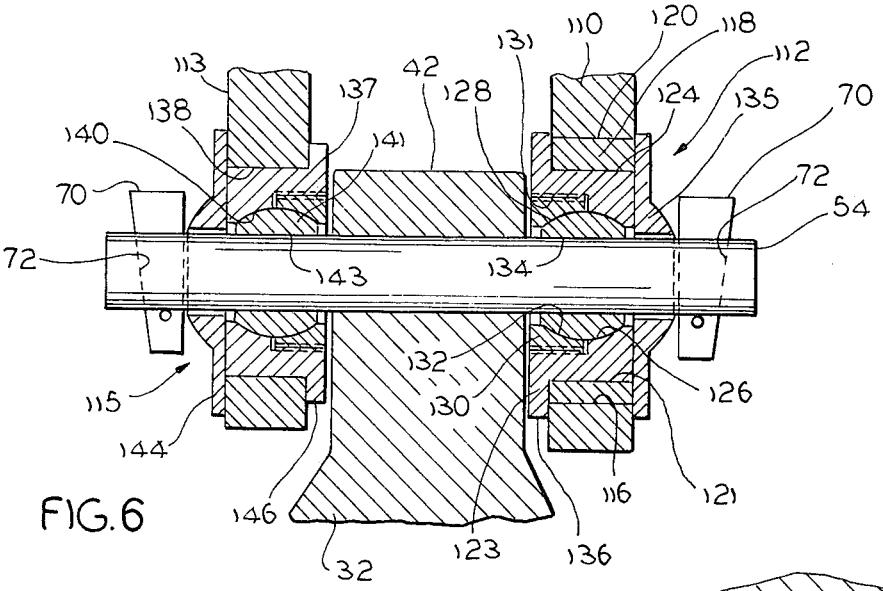
FIG. 6 shows an alternate embodiment of a portion of the suspension assembly according to the present invention.
Figure 7:
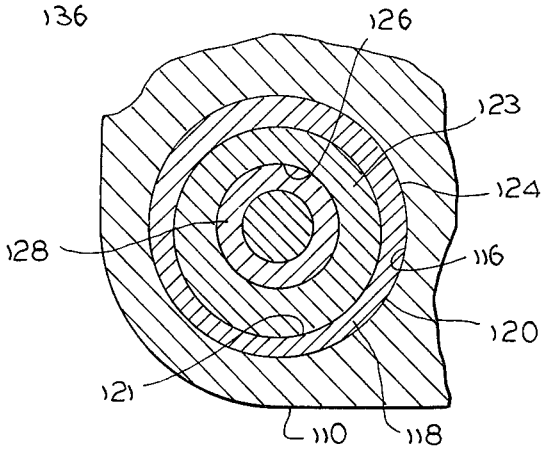
FIG. 7 is a view taken along lines 8—8 of FIG. 7.

FIGS. 6 and 7 show an alternate embodiment of the invention wherein the pin 54 is mounted in a first lug 110 by an eccentric ball assembly 112 and in a second lug 113 by a concentric ball assembly 115. The eccentric ball assembly 112 is disposed within a concentric opening 116 formed in lug 110 and includes an alignment ring 118 having an outer concentric surface 120 that engages the surface of the opening 116 and an inner eccentric surface 121. Disposed within ring 118 is a ball holder 123 whose outer surface 124 is eccentric and engages the surface 121 of ring 118. The inner surface of ball holder 123 is a concentric spherical section 126 which receives a ball 128. In addition, a ball retaining plug 130 is threadably received in a concentric opening 131 in ball holder 123 and has an inner surface 132 forming a concave spherical section for engaging ball 128. A bore 134 is formed in ball 128 for receiving the pin 54 therethrough. The ring 118 is held in the opening 116 by means of a retainer washer 135 which engages one side of lug 110 and a flange 136 which extends radially from the ball holder 123 and engages the opposite side of lug 110.

The concentric ball assembly 115 includes a ball holder 137 disposed within a concentric opening 138 in the lug 113. The inner surface of ball holder 137 is a concentric spherical section 140 for engaging a ball 141 which is identical to ball 128 and has a bore 143 for receiving pin 54. The ball assembly 115 is retained in position within opening 138 by means of a washer 144 identical to washer 135 and a flange 146 extending outwardly from the ball carrier 137. The assemblies 112 and 115 and the pin 54 held in position by means of wedges 70 received in tapered slots 72 formed in the same manner as the embodiment of FIG. 5.

As a result of the eccentricity of the ball holder 123, the shaft 54 will be free to assume a position which is out of alignment with the bolt 46 about which its lower in pivots. Accordingly, undue stresses will not be induced in the pin 54 or the bolt 46 due to localized distortions and the shell 12.

The lower suspension assembly 28 includes a second clamp ring 74 which is configured similarly to the upper clamp ring 30 and a plurality of links 75. The long leg 76 of ring 74 is disposed in a generally parallel relation to the lower flange 21 and there are a plurality of spaced apart disk springs 78 disposed therebetween. The short leg 80 of ring 74 also hooks behind the lower inside edge of flange 21.

Each of the links 75 includes a pair of eye-bolts 82 each of which includes a head portion 84 having a transverse aperture 86 and a threaded shank 88. An internally threaded sleeve 90 engages each of the shanks 88 so that the distance between the apertures 86 and hence, the length of each link 75 may be adjusted. The lower end of each link 75 is pivotally mounted by means of a bolt 91 between a pair of brackets 92 affixed in spaced apart parallel relation to a second ring 94 affixed generally below trunnion ring 16. Bolts 91 extend through apertures 86 and aligned holes 96 in brackets 92. The upper end of each link 75 is similarly pivotally mounted by means of bolts 98 between a second pair of brackets 99 affixed to a lower surface of clamp ring 74. Bolts 98 extend between holes 102 in brackets 99 and through apertures 86 in the upper ends of links 75. The bolts 91 and 98 are arranged in a generally parallel relation to permit simultaneous pivotal movement of links 75 at their opposite ends and each is threaded at one end for being secured by means of bolts 104.

While brackets 58 and 82 are shown in FIG. 2 to have substantially the same height as their respective rings 16 and 94, they may, for added strength, be of increased height and have portions (not shown) which engage and are affixed to the surface of shell 12.

In the preferred embodiment of the invention shown in FIG. 5, all of the upper links 32 are arranged such that their relatively larger base portions 40 are attached to upper clamp ring 30 and their relatively smaller neck portions 42 are pivotally connected to ring 56. However, alternate links 32 may be inverted so that their base portions 40 are pivotally connected to ring 56 while their smaller neck portions 42 are pivotally connected to clamp ring 30.

It will be appreciated that there are a plurality of links 32 of the upper suspension assembly 26 and a plurality of links 75 of the lower suspension assembly 28 which are disposed in spaced apart relation around the vessel 10 and all are pivotally connected to the vessel shell 12 and to the respective upper and lower clamp rings 30 and 74 in the manner discussed with respect to FIGS. 2–5. This permits differential radial expansion of the vessel 10 and the trunnion ring 16 as the links 32 and 75 are free to pivot at their opposite ends. For example, should the vessel 10 expand radially to a greater degree than trunnion ring 16, thereby moving the shell toward the right relative to trunnion ring 16 as viewed in FIG. 2, the link 32 will tend to pivot clockwise about bolt 46 and pin 54 and the link 75 will pivot counterclockwise about bolts 91 and 98. Similar pivotal movement in the links 32 and 75 will occur should the vessel grow lengthwise as a result of the temperatures and stresses inherent in its operation. In addition, the ball joint 52 permits slight misalignment to occur between adjacent links 32 as the result of uneven expansion and contraction of vessel 10. Also, the links 32 not only support the vessel when it is in a vertical position, but the links 32 and 75 also furnish support for the vessel when it is in its various intermediate tilted postions and when it is turned up and turned down.

The clamp rings 30 and 74 absorb radial loading from the links 32 and 75 so as to minimize radial stress in the trunnion ring flanges 20 and 21. In addition, the clamp rings 30 and 74 distribute the compressive loads relatively evenly to the trunnion ring when the vessel is vertical. Further, the links 32 and 75 prevent lateral shifting of the vessel during turn-up and turn-down. This is particularly enhanced by the upper links 32 which resist sidewise deflection as a result of their generally triangular configuration. The spring washers 78 between the lower clamp ring 74 and trunnion ring 16 permit relative movement between the clamp ring 74 and the trunnion ring 16 so that links may also be used below the trunnion ring for support during tilting and when the vessel is inverted. As a result, brackets employed in prior art systems to support the vessel during turn-up and turn-down is not required. Additionally, the adjustability of links 75 allow changes in length necessitated by changes in vessel dimensions during operation.

While only a few embodiments of the invention have been illustrated and described, it is not intended to be limited thereby but only by the scope of the appended claims.

I claim:

1. A metallurgical vessel subject to expansion and contraction during its operating cycles, said vessel including:

support means at least partially surrounding said vessel, a plurality of members disposed in spaced apart relation around said vessel and each including first and second ends, first means for pivotally connecting the first end of each member to said vessel and second means for pivotally connecting the second end of each said member to said support, the portion of each member between said ends being free of connection to said vessel, one of said first and second means including a ball joint whereby misalignment may occur between the pivotal connections at the opposite ends of said members as said vessel expands and contracts.

2. The vessel set forth in claim 1 wherein each said first means includes said ball joint and stationary means affixed to said vessel, said ball joint coupling the first end of its associated member to said stationary means.

3. The metallurgical vessel set forth in claim 2 wherein each said ball joint includes ball and socket means, said first means also including pin means extending axially through each said ball and socket means and through the first end of the associated member for pivotally mounting said members to said stationary means.

4. The metallurgical vessel set forth in claim 3 wherein said members are generally triangular and each has a narrow end and a wide end, said ball joint coupling the narrow ends of said members to said vessel.

5. The metallurgical vessel set forth in claim 4 wherein said stationary means includes a pair of spaced apart members, each said ball being disposed between a pair of said members, and said socket means being provided in each said members.

6. The metallurgical vessel set forth in claim 5 wherein said spaced apart members include opposed parallel surfaces, each said balls including parallel flat portions each engaging one of said surfaces whereby said balls are retained in position, one end of each said members being free for limited pivoting and rocking movement on one of said balls.

7. The metallurgical vessel set forth in claim 4 wherein each said stationary means includes a pair of spaced apart stationary members, a ball joint disposed in each of said stationary members, the one end of each said members being disposed between a pair of said ball joints and pin means extending through each pair of said ball joints and the first end of one of said members disposed therebetween, one of each said pair of ball joints being eccentrically mounted on one of said stationary members.

8. The metallurgical vessel set forth in claim 7 wherein each of said ball joints includes a ball and a socket, each of said balls being axially mounted on their associated pin, one of the sockets of each pair being eccentrically mounted for rotation about said pin and on said one stationary member.

9. A metallurgical vessel subject to expansion and contraction during its operating cycles and including:

support means at least partially surrounding said vessel, a plurality of generally triangular members disposed in spaced apart relation around said vessel and each including wide and narrow ends, pivot means for pivotally connecting the wide end of each said member to said support, a plurality of pairs of members fixed to said vessel in spaced relation, the narrow end of each triangular members being disposed between one of said pair of fixed members, and a ball joint coupling the narrow end of each triangular members to said fixed members, the portion of each members between said pivot means and said ball joint being free of connections to said vessel whereby misalignment may occur between said pivot means and ball joint as said vessel expands and contracts.

10. The vessel set forth in claim 9 and including a trunnion support having upper and lower surfaces, said support means abutting the upper surface of said trunnion support, a second support means abutting the lower surface of said trunnion support, a second plurality of members spaced around said vessel and each being pivotally mounted at one end to said vessel and at their other ends to said second support means.

11. The vessel set forth in claim 10 and including spring means disposed between said second support means and the lower surface of said trunnion support.

12. The vessel set forth in claim 11 wherein there is a gap between said second support means and the lower surface of said trunnion support, the spring means being disposed in said gap and comprising a plurality of spaced apart spring washers.

* * * * *